US005456176A

United States Patent [19]

Strasser

[11] Patent Number: 5,456,176

[45] Date of Patent: Oct. 10, 1995

[54] ROTARY PRINTING PRESS

[75] Inventor: Georg Strasser, Halden, Switzerland

[73] Assignee: Ferd. Ruesch AG, St. Gallen, Switzerland

[21] Appl. No.: 179,791

[22] Filed: Jan. 11, 1994

[51] Int. Cl.[6] ..... B41F 5/00

[52] U.S. Cl. ..... 101/219; 101/228; 226/197

[58] Field of Search ..... 101/212, 216, 101/219, 221, 225, 228; 226/197

[56] References Cited

U.S. PATENT DOCUMENTS

| | | | |
|---|---|---|---|
| 1,873,301 | 8/1932 | Dean | 101/219 |
| 3,605,615 | 6/1969 | Huck . | |
| 3,902,418 | 9/1975 | Morishita et al. | 101/228 |
| 5,199,351 | 4/1993 | Shibuya et al. | 101/228 |

FOREIGN PATENT DOCUMENTS

| | | | |
|---|---|---|---|
| 1054850 | 5/1979 | Canada | 101/219 |
| 198806 | 8/1920 | Germany . | |
| 1303185 | 1/1973 | United Kingdom | 101/228 |

*Primary Examiner*—Eugene H. Eickholt
*Attorney, Agent, or Firm*—Kenyon & Kenyon

[57] ABSTRACT

A rotary printing press with two or more printing units arranged concentrically, in parallel planes, to two or more impression cylinders which are mounted at one end on a shaft, and with one or more web-shifting devices, the impression cylinders being provided with sleeves of different outer surfaces which can be placed thereover for the use of different printing processes.

3 Claims, 2 Drawing Sheets

ROTARY PRINTING PRESS

The object of the present invention is a rotary printing press, in particular for the printing of labels, having printing units for different printing processes arranged around two or more impression cylinders.

Central impression cylinders around which several printing units are arranged have been known for decades.

The advantages of central impression cylinders for the arrangement of a plurality of printing units around the circumference of the impression cylinder not only include the advantage of a compact construction as compared with known printing units which are arranged one behind the other, each having its own impression cylinder associated with the printing unit but also the advantage, particularly in the case of materials to be printed which are sensitive to stretching, that the printing material rests continuously against the impression cylinder while being worked by several printing units arranged one behind the other around the impression cylinder. In this way, the result is obtained that as a rule no additional control devices, which are today mainly electronically controlled, are required in order to control the accuracy of the register.

Central impression cylinders with concentrically arranged printing units, on the other hand, have the disadvantage as compared with horizontally or vertically arranged printing units each having its own impression cylinder that as a result of the necessary limiting of the diameter and thus of the circumference of the impression cylinder, the number of printing units arranged around the circumference of the impression cylinder is limited. Upon substantial increase of the circumference of an impression cylinder, not only do the printing units located in the upper region become poorly accessible but, with the increase in the circumference, the required roundness of the cylinder can no longer be controlled at reasonable cost. Finally, in the event of more than four printing units, there is the disadvantage that in the case of the printing units arranged in the upper and lower regions of the impression cylinder, which must necessarily be arranged horizontally, the angle of application with respect to the direction of printing which is as horizontal as possible is increased.

Another disadvantage of a central impression cylinder is furthermore that only printing methods to which the surface of the impression cylinder corresponds can be used.

It is the object of the present invention, while maintaining the advantage of central impression cylinders, to find a solution which not only permits the provision of an increased number of printing units as compared with traditional solutions but also permits the use of several printing processes by several printing units.

In accordance with the present invention, two or more impression cylinders arranged on a shaft which is mounted on one side are used. Printing units of known type are arranged in parallel planes for the impression cylinders. Furthermore, after the last printing unit of the first impression cylinder, seen in the direction of travel of the web, there is provided a web-shifting device by which the web is guided from the first impression cylinder to the second impression cylinder.

The provision of two or more impression cylinders on one shaft in accordance with the invention has the advantage, first of all, that, as compared with known rotary printing presses having only one impression cylinder, the diameter of the impression cylinders is limited to a value which can be coped with and the number of printing units arranged around the corresponding impression cylinder and the number of the associated drying devices can be reduced. If, in known rotary printing presses up to six printing units are arranged around an impression cylinder, the number of printing units per impression cylinder can be limited to two to four with the arrangement in accordance with the invention. This not only has the advantage that the web run-on path on the impression cylinder can be so lengthened that the web is stabilized on the impression cylinder before it reaches the first printing unit, but also the additional advantage that the distance between the individual printing units can be increased. In this way, not only is the drying of the ink necessary behind each printing unit optimized, but drying devices of smaller dimension and thus more economical in energy can also be used.

The arrangement in accordance with the invention furthermore has the advantage that different printing methods such as flexographic printing and letterpress printing, which require a soft or hard surface of the impression cylinder, can be used in the manner that the impression cylinders are provided with outer surfaces of different hardness corresponding in each case to the printing process employed.

Since with different printing processes with different surfaces of the impression cylinder, the slight differences in circumference of the impression cylinders may occur due to deformation of the surface upon the printing, it is advantageous to drive the impression cylinders independently of each other. Thus, for instance, with a common drive of both impression cylinders, the circumferential speed of the one impression cylinder can be increased by means of an auxiliary gearing.

The impression cylinders can, however, also be driven by separate individual drives.

In order to avoid the installing and removing of an impression cylinder having a different outer surface, it is advantageous to use impression cylinders which are provided with a detachable tubular steel shell, which shells, in their turn, have a surface which is adapted to a given printing process. Such shells are preferably fastened to the impression cylinder by oil-pressure bond.

The web-shifting device of the invention consists of two round bars fixed in position parallel to each other arranged at a given angle to the direction of the web and at a given distance apart, in which connection, for the parallel transfer of the web, the angle amounts to 45° and the distance apart corresponds to the width of the web or the width of the shell of the impression cylinder.

For further explanation of the invention, reference is had to an embodiment of the invention shown in FIGS. 1 to 3 of the drawing, in which.

The rotary printing press 1 consists of a housing 4 which contains the necessary drives and units and on the front side of which, arranged centrally and parallel to each other, there are two impression cylinders 2 and 3. Around each of the impression cylinders 2, 3 there are arranged, in two parallel planes, four printing units 5 and 6 and, behind each printing unit, a drying unit (not shown).

Figure 1:
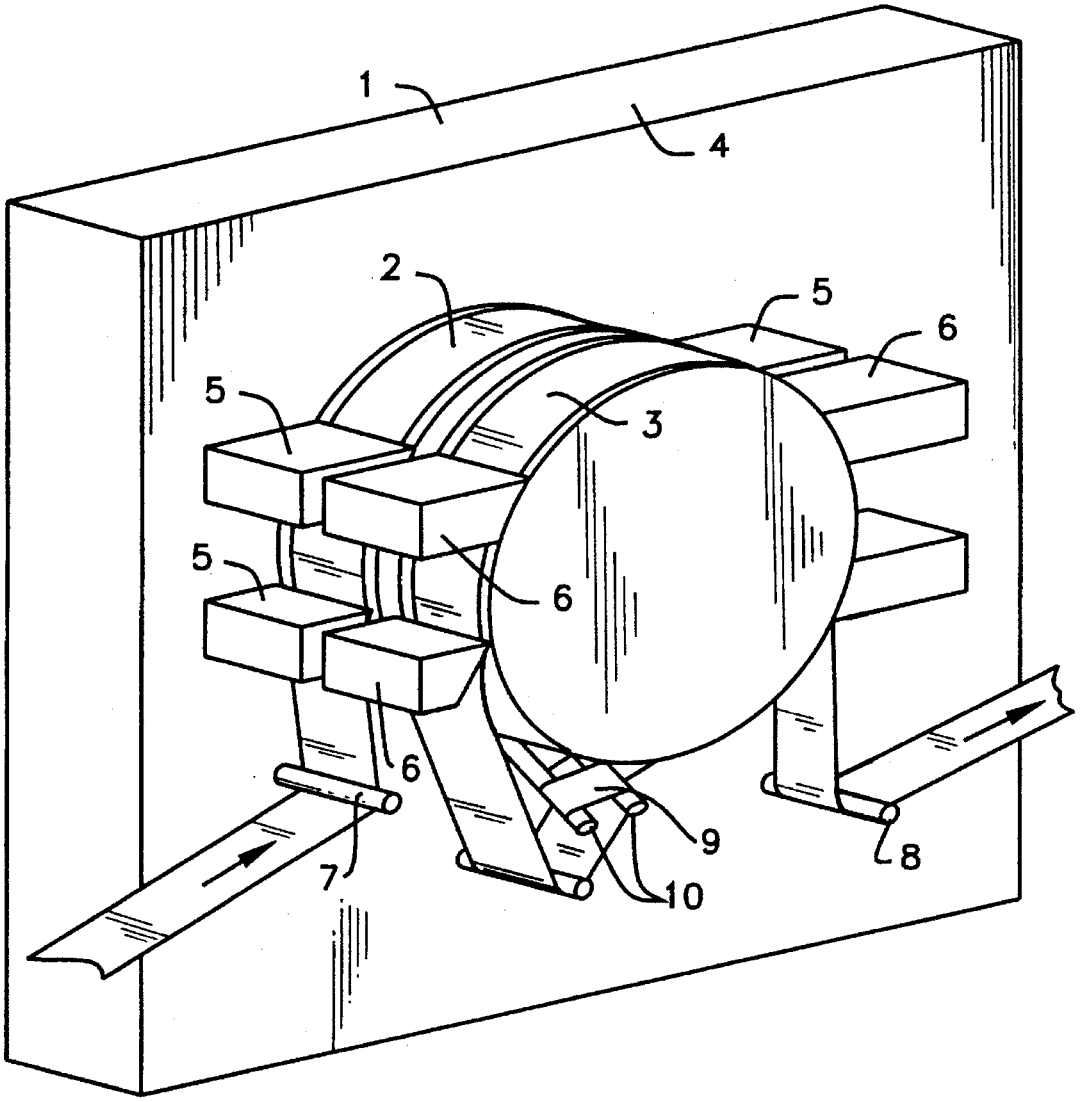
FIG. 1 is a diagrammatic side view in perspective of the rotary printing press.
Figure 2:
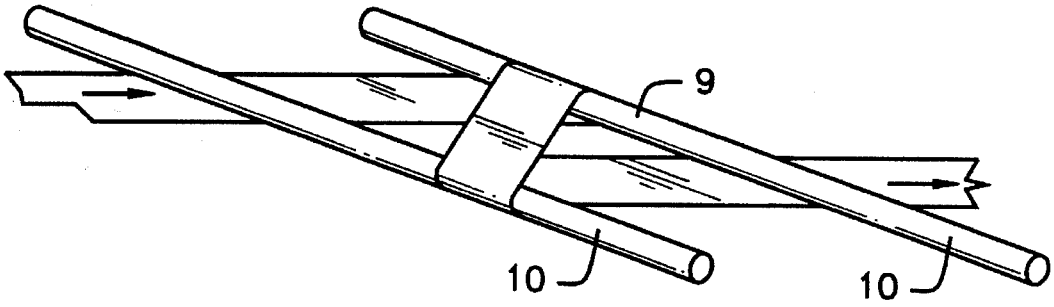
FIG. 2 is a diagrammatic showing of the web-shifting device.

The web-shifting device 9 shown in FIG. 2, which is arranged on the lower periphery of the impression cylinders 2, 3 consists of two round bars 10 which are mounted displaceably on the housing 4 of the rotary printing press 1, the distance between each other and their angle with respect to the impression cylinders 2, 3 being adjustable.

Figure 3:
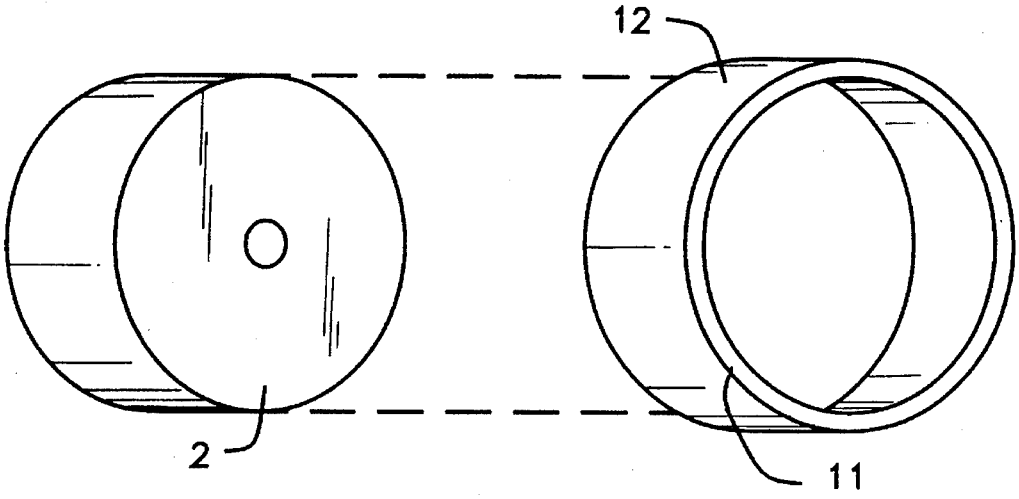
FIG. 3 is a diagrammatic showing of an impression cylinder and a tubular steel shell which can be pushed over it.

The sleeve 11 shown in FIG. 3 consists of a steel tube which can be pushed over the impression cylinder 2, its surface 12 consisting of a rubber blanket. A corresponding sleeve 11 having a hard surface is present on the impression cylinder 3. The diameter of the two impression cylinders 2, 3 is the same. Deformations during the printing of the steel tube 11 covered by a rubber blanket, which deformations may amount to up to 5/100 mm, make it necessary, however, to drive the rubber-blanket impression cylinder 2 minimally faster than the impression cylinder 3, this being achieved by an auxiliary gearing (not shown) which acts on the common drive of the impression cylinders 2, 3.

The web which is to be printed is fed via a feed roller 7 to the impression cylinder 2 and fed, after moving round same, via the web-shifting device 9 to the impression cylinder 3, and after travel around it, led away via the roller 8 for further processing by devices not shown in the drawing.

I claim:

1. A rotary printing press having two or more printing units arranged concentrically in parallel planes to two or more impression cylinders mounted at one end on a shaft, and having at least one web-shifting device between said printing units characterized by the fact that the impression cylinders (2, 3) are driven independently of each other, and characterized by the fact that the impression cylinders (2, 3) have different outer surfaces (12) , and characterized by the fact that detachable sleeves (11) with different outer surfaces (12) are arranged on the impression cylinders (2, 3).

2. A rotary printing press according to claim 1, characterized by the fact that the sleeves (11) are arranged by oil-pressure bonding in easily detachable manner on the impression cylinders (2, 3).

3. A rotary printing press according to claim 1, characterized by the fact that the web-shifting device (9) consists of two round bars (10) which are arranged parallel to each other above or below the impression cylinders (2, 3) on the housing (4) and are displaceable in their angle to the direction of the web.

* * * * *